US005534172A

United States Patent [19]

Perry et al.

[11] Patent Number: 5,534,172

[45] Date of Patent: Jul. 9, 1996

[54] CUTTING FLUID

[75] Inventors: Phillip G. Perry, Webster; Gene W. O'Dell, Williamson, both of N.Y.; Ronny W. F. van Asten, Asten, Netherlands

[73] Assignee: Xerox Corporation, Stanford, Conn.

[21] Appl. No.: 404,382

[22] Filed: Mar. 14, 1995

Related U.S. Application Data

[63] Continuation-in-part of Ser. No. 143,720, Nov. 1, 1993, abandoned.

[51] Int. Cl.[6] ..... C10M 173/00

[52] U.S. Cl. ..... 508/156; 219/69.14; 508/205; 508/209; 508/212; 508/214; 508/159

[58] Field of Search ..... 252/49.3, 49.5, 252/49.6; 219/69.14

[56] References Cited

U.S. PATENT DOCUMENTS

| | | | |
|---|---|---|---|
| 3,000,826 | 9/1961 | Gilliland | 252/49.3 |
| 3,079,340 | 2/1963 | Reamer . | |
| 3,719,598 | 3/1973 | King | 252/33.4 |
| 3,773,579 | 11/1973 | Michelson et al. . | |
| 3,833,502 | 9/1974 | Leary et al. . | |
| 3,980,571 | 9/1976 | Marx . | |
| 4,169,068 | 9/1979 | Harita et al. . | |
| 4,269,739 | 5/1981 | Grejsner | 252/547 |
| 4,313,837 | 2/1982 | Vukasovich et al. . | |
| 4,673,509 | 6/1987 | Davis | 210/669 |
| 4,769,162 | 9/1988 | Remus . | |
| 4,927,550 | 5/1990 | Cuther et al. . | |
| 5,062,978 | 11/1991 | Weber et al. | 252/49.3 |
| 5,110,494 | 5/1992 | Beck . | |
| 5,132,046 | 7/1992 | Edebo et al. | 252/49.3 |
| 5,170,683 | 12/1992 | Kawada et al. . | |
| 5,185,235 | 2/1993 | Sato et al. . | |
| 5,207,838 | 5/1993 | Googin et al. . | |
| 5,215,675 | 6/1993 | Wilkins et al. . | |
| 5,349,149 | 9/1994 | Shiraki et al. | 252/49.3 X |

OTHER PUBLICATIONS

Trimmist Product Sheet (date unknown).

TrimMist product information sheet; Master Chemical Corporation; Jun. 1991.

Hycheck product information sheet; Difco date unknown.

Dow Corning 190 and 193 surfactants product information sheet; Dow Corning Corporation Date unknown.

*Primary Examiner*—Prince Willis, Jr.
*Assistant Examiner*—Cephia D. Toomer
*Attorney, Agent, or Firm*—Oliff & Berridge

[57] ABSTRACT

An aqueous-based cutting fluid for machining photoreceptor substrates contains:

(A) at least one antioxidant;

(B) one or more surfactants, at least one of which is a polysiloxane surfactant;

(C) at least one lubricant; and (D) water.

The cutting fluid can also optionally contain one or more biocides. The cutting fluid is environmentally safe, non-toxic and biodegradable and can be removed in a postmachining cleaning process using only high quality distilled water.

22 Claims, No Drawings

CUTTING FLUID

This application is a Continuation-in-Part of application Ser. No. 08/143,720 filed Nov. 1, 1993, now abandoned.

FIELD OF THE INVENTION

This invention relates to cutting fluids. More particularly, this invention relates to cutting fluids for use in machining photoreceptor substrates.

BACKGROUND OF THE INVENTION

Many electrophotographic copiers, digital copiers, laser printers, and the like contain an electrophotographic photoreceptor wherein a photoconductive layer is provided on a rotatable drum-like substrate. The substrate may be made by machining the surface of a pipe, and a cutting fluid is normally used in this process. The cutting fluid is used to cool, lubricate, and clean the substrate. Many current processes for machining photoreceptor substrates use a petroleum-based cutting fluid.

For inspection purposes and to prepare the substrates for final cleaning and coating of photoconductor layers, the substrates are cleaned after machining to remove residual cutting fluid. Typically, petroleum residues on a substrate are removed with an ultrasonic vapor degreaser using a chlorine solvent, such as, for example, 1,1,1-trichloroethane, trichloroethylene, perchloro-ethylene, methylene chloride, and the like. However, the use of such solvents can cause problems of environmental contamination and working safety from the viewpoint of ozone layer destruction, carcinogenicity and the like.

Alternatives to chlorine-containing solvents include aliphatic hydrocarbons such as kerosene or strong acid-based detergents. However, these alternatives can present new problems including fire risks and waste neutralization.

A preferred alternative to chlorine solvents would be an aqueous cutting fluid which could be cleaned with a neutral aqueous cleaner. A number of commercial aqueous cutting fluids (e.g., Parker-Amchem 718, TrimMist, Hysol, TrimSol) have been found to be unsatisfactory. A major problem with these cutting fluids is that they either attack metal on the surface of the substrate or alter the substrate surface chemistry, especially with aluminum substrates, so that the substrate has the undesirable characteristic of wetting after subsequent cleaning. Also, such cutting fluids have poor water-break characteristics. These poor properties can result in incomplete coating of the substrate by the cutting fluid and the retention of contaminants on the substrate surface following cleaning, including the retention of water beads. Such defects lead to the rejection of an unacceptably large number of substrates as substrates for receiving photoconductor coatings.

Known cutting fluids do not include or suggest the use of the combination of materials of the aqueous based cutting fluids of the present invention, which achieve surprising performance results as discussed herein. A TrimMist Product Information Sheet discloses a cutting fluid concentrate comprising amine borate, propylene glycol, amine carboxylate, nonionic surfactant, nonsilicone, anti-foam agent and water. In Section 4 of the Product Information Sheet, it is disclosed that the pH of the concentrate is 8.3, and that when diluted to a 10% solution, the pH increases to 8.6. There is no disclosure or suggestion to use a polysiloxane surfactant, or to adjust the pH to a range of from 7.0 to 8.0.

Gililland, U.S. Pat. No. 3,000,826, discloses a metal working lubricant comprising polyethylene or polypropylene glycol, water, and an anti-rust material that is a combination of an alkali metal nitrite and an aliphatic alkanol amine. Gililland does not disclose or suggest the use of a surfactant, much less a polysiloxane surfactant, and in fact teaches that cutting fluids containing surfactants are inferior in performance to the cutting fluid disclosed.

King, U.S. Pat. No. 3,719,598, discloses an aqueous cutting fluid comprising the reaction product of a boric acid and an aliphatic amine, a petroleum sulfonate, and a nonionic wetting agent. King indicates that the cutting fluid is excellent in corrosion protection. King does not disclose the use of a polysiloxane surfactant or a lubricant such as polyethylene glycol.

Remus, U.S. Pat. No. 4,769,162, discloses a water based lubricant for a conveyor. No mention is made of aqueous based cutting fluids. The composition of the lubricant comprises an anionic surfactant, water or solvent, and an aluminum salt. Optionally, a weak acid may be added in an amount to adjust the pH to between 4 and 6 in order to prevent formation of aluminum hydroxides. Remus does not disclose or suggest a cutting fluid within a pH range of 7 to 8, nor the use of a polysiloxane surfactant in such cutting fluid.

SUMMARY OF THE INVENTION

This invention provides a cutting fluid that is particularly useful for machining photoreceptor substrates. The residues of the cutting fluid can be removed from the substrate by deionized water alone. Because deionized water is used to remove the cutting fluid residues, the removal of the cutting fluid residues from the substrate does not pose a risk to the environment or to working safety. Furthermore, the cutting fluid of this invention does not attack the metal surface of the substrate or alter the surface chemistry so that the substrate has the undesirable characteristic of wetting after subsequent cleaning. The cutting fluid exhibits excellent water-break properties.

The cutting fluid of this invention comprises:

(A) at least one antioxidant;

(B) one or more surfactants, at least one of which is a polysiloxane surfactant;

(C) at least one lubricant; and (D) water.

Also, the cutting fluid can optionally contain one or more biocides.

The cutting fluid of this invention itself can be environmentally safe, non-toxic and biodegradable. Furthermore, the cutting fluid (1) poses no fire risk; (2) provides a uniform coverage of a transparent protective coating allowing inspection of the machined part while preventing non-uniform surface oxidation until the substrate can be cleaned; (3) imparts excellent lubricity to the substrate which reduces chipping during the machining, eliminates potential surface damaging particulates and extends the cutting tool life; (4) does not detrimentally impact the substrate surface; and (5) rinses cleanly from the substrate with deionized water with excellent water-break, thereby preventing the deposition or retention of contaminants on the substrate surface.

DETAILED DESCRIPTION OF PREFERRED EMBODIMENTS

The cutting fluid of this invention contains (A) at least one antioxidant; (B) one or more surfactants, at least one of which is a polysiloxane surfactant; (C) at least one lubricant; and (D) water.

Preferably, the cutting fluid contains (A) from about 0.01 to about 10 parts by weight of antioxidant; (B) from about 0.1 to about 5 parts by weight of surfactant, including from about 0.01 to about 3 parts by weight of a polysiloxane surfactant; (C) from about 1 to about 20 parts by weight of lubricant; and (D) from about 70 to about 98.9 parts by weight of water, and the sum of (A)–(D) may be 100 parts by weight.

More preferably, the cutting fluid contains (A) from about 0.01 to about 1 parts by weight of antioxidant; (B) from about 1.0 parts to about 4 parts by weight of surfactant, including from about 0.01 to about 1 parts by weight of a polysiloxane surfactant; (C) from about 1 parts to about 4 parts by weight of lubricant; and (D) from about 90 to about 98 parts by weight of water, and the sum of (A)–(D) may be 100 parts by weight.

Most preferably, the cutting fluid contains (A) about 0.02 part by weight of antioxidant; (B) about 3 parts by weight of surfactant, including about 0.02 parts by weight of a polysiloxane surfactant; (C) about 2 parts by weight of lubricant; and (D) about 95 parts by weight of water.

The antioxidant (A) prevents corrosion and spontaneous combustion of any metallic fines. Preferably, the antioxidant is an amine or carboxylic acid salt. Preferred amines for use in the cutting fluid include, for example, triethanolamine, ethylene diamine tetraacetic acid (EDTA), an amine borate, or an amine carboxylate. Any amine borate or amine carboxylate is suitable, without limitation. As examples of amine borates, mention may be made of amine borates disclosed in U.S. Pat. Nos. 2,999,064 and 3,719,598. Amine carboxylates, for example, can be made from (a) carboxylic acids such as aliphatic, cycloaliphatic or aromatic carboxylic acids that may have, for example, 1 to 26 carbon atoms, including acetic acid, lactic acid, citric acid, malic acid, oleic acid, oxalic acid, stearic acid, benzoic acid and salicylic acid, and (b) any amine compound such as an amine having from 1 to 30 carbon atoms, in any branched, straight chain or cyclic structure, including amines mentioned above for use in an amine borate.

Most preferably, the antioxidant is triethanolamine or an antioxidant commercially available from Master Chemical Corporation under the designation "TrimMist". TrimMist contains amine borate, propylene glycol, amine carboxylate, a non-ionic surfactant and a non-silicone non-foaming agent.

The surfactant (B) provides uniform cutting fluid coverage on the substrate after machining and also facilitates removal of the cutting fluid's residues. The surfactant should be of a non-foaming type that will facilitate removal of the lubricant yet not react with metal on the substrate surface to produce etching or to increase its surface energy so that subsequent rinsing in deionized water causes the surface to remain wet.

The surfactant can be a mixture of one or more surfactants. However, at least one of the surfactants must be a polysiloxane surfactant. The polysiloxane surfactant is necessary in order to provide the necessary water-break properties, that is, in order to provide a sufficient hydrophobic surface following aqueous cleaning that prevents water beading and the deposition or retention of contaminants upon the substrate surface. The presence of antioxidant such as triethanolamine allows for a clear, transparent film to be placed upon the substrate during lathing, thereby enabling easy inspection of the substrate for defects following lathing. However, the antioxidant has been found to adversely affect the water-break characteristics of the cutting fluid. The inventors have found that the addition of a polysiloxane surfactant results in a cutting fluid that coats a transparent film on the substrate while at the same time having excellent water-break properties. Without the antioxidant, a hazy film is produced which inhibits inspection of the substrate following lathing, while without the polysiloxane surfactant, water beading may occur.

The polysiloxane surfactant can be any polysiloxane compound having a hydrophilic/lipophilic balance (HLB) of, for example, 10 or more so that it is water-soluble. Preferably, the polysiloxane surfactant has an HLB of from 14 to 16. The polysiloxane surfactant preferably is ethoxylated and propoxylated, and will have one or more of each group bonded to an internal siloxane group. A preferred example of a suitable polysiloxane surfactant is dimethyl, methyl(propylpolyethylene oxide polypropylene oxide acetate)siloxane. Also, a commercially available polysiloxane surfactant suitable for use in the cutting fluid of this invention is Dow Corning 190 or 193, available from Dow Corning Corporation, Midland, Mich.

The cutting fluid preferably contains at least one other surfactant in addition to the polysiloxane surfactant. The additional surfactant can be anionic, cationic or nonionic. Preferably, the surfactant is non-ionic and should have a hydrophilic/lipophilic balance (HLB) of greater than about 12 and preferably in the range of from about 12 to about 18.

Examples of suitable anionic surfactants include, for example, higher alkyl sulfonates, higher alcohol sulfuric acid esters, phosphoric acid esters, carboxylates, and the like. Examples of suitable cationic surfactants include, for example, benzalkonium chloride, Sapamine-type quartenary ammonium salts, pyridinium salts, amine salts, and the like. Preferably, the surfactant is non-ionic. Examples of suitable non-ionic surfactants include copolymers of propylene oxide and ethylene oxide, and ethoxylated ethanols, and the like.

Most preferably, the additional surfactant used in this invention is Triton X-114 (octylphenoxy polyethoxy ethanol), Pluronic L-35 (propyleneoxide/ethyleneoxide copolymer) or Alkamuls PSML20 (polyoxyethylene glycol sorbitan monolaurate).

The lubricant (C) provides a smooth cutting action, minimizes chipping and insures minimal wear to the cutting tool. Preferably, the lubricant is a polyhydric alcohol. Examples of suitable polyhydric alcohols include dihydric alcohols, e.g., glycol such as ethylene glycol, propylene glycol, trimethylene glycol, and neopentyl glycol; dihydric alcohols containing ether bonds such as diethylene glycol and dipropylene glycol; dihydric alcohols derived through nitrogen such as diethanolamine; or dihydric alcohols containing ester bonds such as oleic acid monoglyceride.

Examples of other polyhydric alcohols include glycerin, pentaerythritol, sorbitan monolaurate, and sorbitan trioleate.

Preferably, the lubricant used in this invention is polyethylene glycol.

Water (D) functions as a coolant/diluent to control the temperature of the substrate and cutting tool and as a solvent/carrier for the other components of the cutting fluid composition of this invention. The water can be tap or deionized water. Preferably, deionized water having a resistivity greater than about 2 Mohm-cm is used.

Optionally, an acid may be added to the cutting fluid composition of this invention to provide the composition with a pH of from about 7 to about 8. Most preferably, the pH is between about 7.5 to about 8.0. A pH of below about 7.5 may result in phase separation within the aqueous cutting fluid. A pH of above about 8.0 may cause etching of the substrate due to reaction with the substrate surface, which destroys the water-break characteristic.

Examples of suitable acids used for neutralization include citric, boric, tartaric and acetic acids. Preferred acids are citric acid and boric acid.

Preferably, a biocide is added to the cutting fluid of this invention. The cutting fluid ingredients such as glycols, ethoxylates and water provide a nutrient media for bacteria growth. If bacteria growth occurs in the cutting fluid, the lathe apparatus may become plugged. For example, the cutting fluid lines from a reservoir to a nozzle and the atomizer nozzle itself may plug due to the formation of a biofilm. In addition, the bacteria contaminates the substrate surface by causing oils and acids to be deposited on the substrate surface. The deposits are not easily removed in subsequent cleaning steps, often resulting in coating resist areas in subsequent coatings. As above, such contamination results in an unacceptably high number of substrates being rejected for use as substrates for receiving photoconductor coatings.

The addition of a biocide can prevent such bacteria growth, and is an inexpensive alternative to expensive process steps that would otherwise need to be followed to avoid bacteria formation. The inventors have found that the addition of biocides prevents bacteria growth better than the use of ultra-violet (UV) light treatment or submicron filtration. In addition, the use of a biocide allows for the pH to be adjusted to the desired range of about 7 to about 8, thereby negating the need to add a separate acid.

Any known biocide may be used in the cutting fluid, such as quaternary salts. Examples of preferred biocides include benzalkonium chloride, tris(hydroxymethyl)nitromethane (commercially available under the trade name TrisNitro from ANGUS Chemical Co.), and tetrakishydroxymethylphosphonium sulphate (THPS) (commercially available under the tradename Tolcide PS-71A from ALBRIGHT & WILSON LTD.). Most preferably, the biocide is THPS because THPS is very safe to the environment and does not attack the aluminum substrate.

If a biocide is added to the cutting fluid, it should be contained in an amount effective to prevent bacteria growth in the cutting fluid. Preferably, the biocide should be present in an amount ranging from about 0.01 to about 1 vol. %, most preferably 0.1 vol. %, based on the volume of the cutting fluid.

A preferred cutting fluid composition of this invention comprises: (A) about 0.01 to about 0.02 parts by weight of triethanolamine; (B) about 1 to about 5 parts by weight of a surfactant that may be polyethylene glycol sorbitan monolaurate and/or octylphenoxy polyethoxy ethanol, with the total amount of surfactant including about 0.01 to about 0.1 parts by weight dimethyl,methyl(propylpolyethylene oxide polypropylene oxide acetate)siloxane; (C) about 1 to about 4 parts by weight polyethylene glycol; and (D) about 90 to about 98 parts by weight deionized water. More preferably, the cutting fluid also contains at least one biocide in an amount ranging from about 0.01 to about 1 volume percent of the cutting fluid.

Another preferred cutting fluid comprises: (A) about 1 to about 4 parts by weight of an antioxidant containing an amine borate, propylene glycol, amine carboxylate, a nonionic surfactant and a non-silicon nonfoaming agent (i.e., Master Chemical TrimMist); (B) about 0.1 to about 2 parts by weight of octylphenoxy polyethoxy ethanol; (C) about 1 to about 4 parts by weight of polyethylene glycol; and (D) about 90 to about 98 parts by weight of deionized water, optionally also containing a biocide.

The cutting fluid may be used in the lathing and cleaning process disclosed in copending, commonly assigned U.S. application Ser. No. 08/143,721, now U.S. Pat. No. 5,346,556, filed simultaneously with the instant application and incorporated by reference herein.

After the cutting fluid residues are removed from the substrate, which is preferably an aluminum substrate, the substrate may be coated with any suitable coatings to fabricate an electrostatographic imaging member, e.g., an electrophotographic imaging member or an ionographic imaging member.

To form electrophotographic imaging members, the substrate may be coated with a blocking layer, a charge generating layer, and a charge transport layer. Optional adhesive, overcoating and anti-curl layers may also be included. Alternatively, a single photoconductive layer may be applied to the substrate. If desired, the sequence of the application of coatings of multilayered photoreceptors may be varied. Thus, a charge transport layer may be applied prior to the charge generating layer. The photoconductive coating may be homogeneous and contain particles dispersed in a film-forming binder. The homogeneous photoconductive layer may be organic or inorganic. The dispersed particles may be organic or inorganic photoconductive particles. Thus, for the manufacture of electrophotographic imaging members, at least one photoconductive coating is applied to the substrate.

Ionographic imaging members can be formed by coating the substrate with a conductive layer, a dielectric imaging layer, and an optional overcoating layer.

EXPERIMENTAL

Examples 1–6

In Examples 1–6, an aluminum substrate is cut on a lathe utilizing a specified cutting fluid according to the present invention. In Examples 1–3, the cutting fluid comprises 2.0% polyethylene glycol, 0.02% triethanolamine, 3.0% polyoxyethylene glycol sorbitan monolaurate (ALKAMULS PSML 20), 0.02% Dow Corning 190 polysiloxane surfactant, 0.1% TrisNitro biocide and remainder deionized water. Example 1 is the substrate achieved following cutting. Example 2 is the substrate following cutting and rinsing with deionized water. Example 3 is the substrate following cutting, rinsing with deionized water and $CO_2$ snow cleaning.

In Examples 4–6, the procedure of Examples 1–3 is repeated except that the cutting fluid comprises 2.0% polyethylene glycol, 0.02% triethanolamine, 0.5% octylphenoxy polyethoxy ethanol (IGEPAL C0-850), 2.0% polyoxyethylene glycol sorbitan monolaurate (Alkamuls PSML20), 0.05% Dow Corning 190 polysiloxane surfactant, 0.1% TrisNitro biocide and remainder deionized water.

The substrates of Examples 1–6 are analyzed by X-ray photoelectron spectroscopy (XPS), which provides elemental, chemical and quantitative analyses for the top 2–3 nm of an aluminum substrate surface. The results are shown in Table I.

TABLE I

| Element | Example 1 at %/wt % | Example 2 at %/wt % | Example 3 at %/wt % | Example 4 at %/wt % | Example 5 at %/wt % | Example 6 at %/wt % |
|---|---|---|---|---|---|---|
| aluminum | 0.2/0.3 | 25/37 | 26/38 | 0.3/0.5 | 29/43 | 26/39 |
| carbon | 70/64 | 27/18 | 27/18 | 68/61 | 25/16 | 25/17 |
| copper | —/— | 0.3/1.0 | 0.4/1.2 | —/— | 0.7/2.2 | 0.4/1.2 |
| fluorine | —/— | 0.6/0.6 | —/— | —/— | 0.5/0.4 | 0.5/0.5 |
| magnesium | —/— | 0.2/0.2 | 0.3/0.3 | —/— | —/— | —/— |
| oxygen | 30/36 | 47/42 | 47/42 | 30/34 | 45/38 | 48/42 |
| silicon | 0.5/0.5 | —/— | —/— | 2/4 | —/— | —/— |

The above results indicate that cutting fluids of the present invention are readily rinsed off with deionized water alone, and the $CO_2$ snow clean has minimal additional effect in cutting fluid removal. Sufficient removal by deionized water alone is demonstrated because silicon from the polysiloxane surfactant in the cutting fluids of Examples 1 and 4 is removed by rinsing alone (Examples 2 and 5). Also, the elemental analysis changes very little from the results following rinsing to the results following the $CO_2$ snow cleaning (Examples 3 and 6).

Comparative Examples 1–8

In Comparative Examples 1–8, an aluminum drum is coated with an aqueous cutting fluid containing 2% polyethylene glycol, 1% octylphenoxy polyethoxy ethanol surfactant, and 10% of a lubricant commercially available from Parker-Amchem under the designation "Parker-Amchem 718 M2" containing several amines and a fluorocarbon surfactant. The substrate is aged for one month and cut into three sections. Comparative Example 1 is the coated substrate aged for one month, Comparative Example 2 is left with the cutting fluid intact, Comparative Example 3 is rinsed with deionized water and Comparative Example 4 is rinsed with deionized water arid subjected to a $CO_2$ snow clean.

Comparative Examples 5–8 repeat the procedure for Comparative Examples 1–4, except that the aqueous cutting fluid comprises 10% Parker-Amchem 718 M2 lubricant.

Before and after aging, the substrate and each of the sections produced in Comparative Examples 1–8 are analyzed by X-ray photoelectron spectroscopy (XPS).

Prior to aging, the substrate shows evidence of surface condensation (due to storage) and oxidation of approximately 60% of the aluminum near the substrate surface. After aging, no additional oxidation is observed.

XPS analysis of the substrate of the Comparative Examples is summarized in Table II.

TABLE II

| Example No. | At % AI/ Wt % AI | At % C/ Wt % C | At % F/ Wt % F | At % O/ Wt % O |
|---|---|---|---|---|
| Comp. 1 | 15/25 | 48/36 | 4/5 | 33/34 |
| Comp. 2 | 3/5 | 51/42 | 7/9 | 40/44 |
| Comp. 3 | 5/9 | 44/35 | 5/7 | 46/49 |
| Comp. 4 | 6/12 | 45/36 | 2/2 | 46/49 |
| Comp. 5 | 2/4 | 70/62 | 4/6 | 24/28 |
| Comp. 6 | 0.4/0.8 | 71/64 | 3/4 | 26/31 |
| Comp. 7 | 5/10 | 56/46 | 4/5 | 36/39 |
| Comp. 8 | 6/11 | 46/37 | 1/1 | 47/51 |

In Comparative Examples 1 and 5, wherein the cutting fluid-laden substrates have been aged for 1 month but not yet cleaned of the cutting fluid residues, the substrate coated with the cutting fluid used in the present invention shows the most complete coverage of the substrate surface by the fluid, as evidenced by the substrate exhibiting the strongest carbon signal and the weakest aluminum signal. The substrate coated in Comparative Example 1 is covered by a thin layer of the material, and signals are detected from both the fluorocarbon containing surfactant and the aluminum substrate. The substrate coated in Comparative Example 5 shows signals from the fluorocarbon surfactant and strong hydrocarbon signals. Only a weak aluminum signal is detected in this example, which indicates that a thicker layer of the cutting fluid covers the surface.

The results of the Comparative Examples indicate that additional elements are removed following the $CO_2$ snow clean, indicating that rinsing with deionized water alone is not sufficient to completely remove the cutting fluid from the aluminum substrate surface.

Comparative Examples 9–17

In Comparative Examples 9–11, an aluminum substrate section is lathed with a 10% aqueous solution of cutting fluid containing Parker-Amchem 718M2 lubricant ("Cutting Fluid D"). In Comparative Examples 12–14, an aluminum substrate section is lathed with a 2.5% aqueous solution of cutting fluid commercially available from Master Chemical Corporation as "Master Chemical TrimMist" that contains amine borates, propylene glycol, amine carboxylates, nonionic surfactants and a nonsilicone nonfoaming agent ("Cutting Fluid E"). In Comparative Examples 15–17, an aluminum substrate section is lathed with a 2.5% aqueous solution of a cutting fluid commercially available from Castrol as "Castrol Hysol X" that contains an oil-in-water emulsion containing petroleum distillates and an alkanolamine ("Cutting Fluid F").

The cutting fluids and lubricant additives used in Comparative Examples 9–17 are set forth in Table III below.

TABLE III

| Example No. | Cutting Fluid | Lubricant Additive |
|---|---|---|
| 9 | D | None |
| 10 | D | 2% PEG |
| 11 | D | 2% TC 157* |
| 12 | E | None |
| 13 | E | 2% PEG |
| 14 | E | 2% TC 157 |
| 15 | F | None |
| 16 | F | 2% PEG |
| 17 | F | 2% TC 157 |

*A surfactant commercially available from Parker Amchem.

Each section is then subjected to the following treatment:

(1) 6 hours after lathing, a 30 second rinse with deionized water at room temperature and then immersion for 10 seconds in deionized water at room temperature ("DI Rinse 1");

(2) 6 hours after lathing, immersion for 30 seconds into a 3% aqueous solution of a commercially available cleaner from Parker-Amchem under the designation "VR5220" and which is a phosphate-containing mild alkaline cleaner with a pH of 9.5 cleaner followed by a 30 second immersion into the cleaner at 85°–90° F. accompanied by ultrasonic energy ("A Clean");

(3) 24 hours after lathing, a 30 second rinse with deionized water at room temperature and then immersion for 10 seconds in deionized water at room temperature ("DI Rinse 2");

(4) 24 hours after lathing, a 30 second immersion into a 3% aqueous solution of a mildly alkaline cleaner commercially available under the designation "Chautaugua GP-M" and containing propylene glycol methyl ether ("B Clean");

(5) 30 hours after lathing, a 30 second rinse with deionized water at room temperature and then immersion for 10 seconds in deionized water at room temperature ("DI Rinse 3");

(6) 6 hours after lathing, immersion for 30 seconds into the cleaner used in "A Clean" and a 30 second immersion accompanied by ultrasonic energy at 85°–90° F. ("C Clean").

After each step of the treatment, the sections are tested for water-break, residue, and fog spots. Water-break is a measure of how well water sheets off of the surface without leaving water drops. Water is contacted with the surface, and the surface is then observed for the amount of water drops that remain. The residue test is a visual observation of the degree of organic residue upon the surface apparent to the naked eye. Fog spots is a test for determining the extent of invisible or latent organic residue on the surface and is evaluated by exhaling breath upon the surface and observing the defects that appear. The sections are also tested for cleanliness by means of a device made by Photoacoustics Technology which measures the level of organic residue and aluminum oxide on the section. A measurement ("PAT") of 1150 and above means that there is no organic residue and very little aluminum oxide while a reading of less than 1150 indicates the presence of organic residue or aluminum oxide. The results are shown in Tables IV–XII below. In the tables below, the following rating is used:

TABLE IV

| | Comparative Example 9: Properties | | | |
|---|---|---|---|---|
| Step | Water-Break | Residue | Fog Spots | PAT |
| DI Rinse 1 | 1 | 3 | 2 | 1148–1149 |
| A Clean | 0 | 0 | 0 | 0 |
| DI Rinse 2 | 3 | 3 | 2 | 1148–1149 |
| B Clean | 0 | 0 | 0 | 0 |
| DI Rinse 3 | 3 | 3 | 2 | 1146–1147 |
| C Clean | 0 | 0 | 0 | 0 |

0 - no evaluation made
1 - poor
2 - fair
3 - good

TABLE V

| | Comparative Example 10: Properties | | | |
|---|---|---|---|---|
| Step | Water-Break | Residue | Fog Spots | PAT |
| DI Rinse 1 | 3 | 3 | 2 | 1146 |
| A Clean | 1 | 0 | 0 | 0 |
| DI Rinse 2 | 3 | 3 | 3 | 1148–1149 |
| B Clean | 1 | 0 | 0 | 0 |
| DI Rinse 3 | 3 | 3 | 3 | 1148–1149 |
| C Clean | 2 | 0 | 2 | 0 |

TABLE VI

| | Comparative Example 11: Properties | | | |
|---|---|---|---|---|
| Step | Water-Break | Residue | Fog Spots | PAT |
| DI Rinse 1 | 3 | 3 | 3 | 1145–1148 |
| A Clean | 2* | 0 | 0 | 0 |
| DI Rinse 2 | 3 | 3 | 3 | 1148–1150 |
| B Clean | 0 | 0 | 0 | 0 |
| DI Rinse 3 | 3 | 3 | 3 | 1148–1149 |
| C Clean | 0 | 0 | 0 | 0 |

*Ultrasonic Pitting

TABLE VII

| | Comparative Example 12: Properties | | | |
|---|---|---|---|---|
| Step | Water-Break | Residue | Fog Spots | PAT |
| DI Rinse 1 | 3 | 2 | 2 | 1015–1130 |
| A Clean | 0 | 3 | 2 | 1148 |
| DI Rinse 2 | 3 | 2 | 2 | 814–832 |
| B Clean | 3 | 3 | 1 | 0 |
| DI Rinse 3 | 2 | 2 | 1 | 827–897 |
| C Clean | 3 | 3 | 1 | 1145–1147 |

*Ultrasonic Pitting

TABLE VIII

| | Comparative Example 13: Properties | | | |
|---|---|---|---|---|
| Step | Water-Break | Residue | Fog Spots | PAT |
| DI Rinse 1 | 3 | 1 | 1 | 1146–1149 |
| A Clean | 0 | 3 | 2 | 1150–1152 |
| DI Rinse 2 | 3 | 2 | 2 | 788–926 |
| B Clean | 3* | 3 | 1 | 976–1025 |
| DI Rinse 3 | 3 | 2 | 2 | 845–980 |
| C Clean | 3 | 3 | 2 | 1144–1146 |

*Ultrasonic Pitting

TABLE IX

| | Comparative Example 14: Properties | | | |
|---|---|---|---|---|
| Step | Water-Break | Residue | Fog Spots | PAT |
| DI Rinse 1 | 3 | 0 | 2 | 1145–1148 |
| A Clean | 3 | 3 | 2 | 1150 |
| DI Rinse 2 | 3 | 2 | 1 | 982–1045 |
| B Clean | 3 | 3 | 2 | 1033–1060 |
| DI Rinse 3 | 3 | 3 | 2 | 883–999 |
| C Clean | 3 | 3 | 2 | 1146–1147 |

TABLE X

| Step | Comparative Example 15: Properties | | | |
|---|---|---|---|---|
| | Water-Break | Residue | Fog Spots | PAT |
| DI Rinse 1 | 3 | 1 | 1 | 1145 |
| A Clean | 0 | 3 | 2 | 1148 |
| DI Rinse 2 | 3 | 1 | 1 | 806–986 |
| B Clean | 0 | 3 | 1 | 1149–1150 |
| DI Rinse 3 | 3 | 1 | 1 | 882–1028 |
| C Clean | 2 | 3 | 1 | 1144–1147 |

TABLE XI

| Step | Comparative Example 16: Properties | | | |
|---|---|---|---|---|
| | Water-Break | Residue | Fog Spots | PAT |
| DI Rinse 1 | 3 | 1 | 1 | 1144–1146 |
| A Clean | 0 | 3 | 2 | 1149–1150 |
| DI Rinse 2 | 3 | 1 | 1 | 862–888 |
| B Clean | 3* | 3 | 1 | 1148–1150 |
| DI Rinse 3 | 3 | 1 | 1 | 800–937 |
| C Clean | 3 | 3 | 1 | 1146–1148 |

*Ultrasonic Pitting

TABLE XII

| Step | Comparative Example 17: Properties | | | |
|---|---|---|---|---|
| | Water-Break | Residue | Fog Spots | PAT |
| DI Rinse 1 | 3 | 1 | 1 | 1144–1148 |
| A Clean | 0 | 3 | 1 | 1144–1148 |
| DI Rinse 2 | 0 | 1 | 1 | 1126–1145 |
| B Clean | 0* | 3 | 1 | 1146–1149 |
| DI Rinse 3 | 3 | 1 | 1 | 965–1040 |
| C Clean | 3 | 3 | 1 | 1146–1147 |

*Ultrasonic Pitting

Examples 7 and 8

Example 7 analyzes the cutting fluid of Example 1 for water-break, residue and fog spots. These properties are also analyzed in Example 8, which uses the cutting fluid of Example 4. The results are shown in Tables XIII and XIV.

TABLE XIII

| Step | Example 7 | | | |
|---|---|---|---|---|
| | Water-Break | Residue | Fog Spots | PAT |
| DI Rinse 1 | 2 | 3 | 3 | 1340 |
| A Clean | 3 | 3 | 3 | 1330–1340 |

TABLE XIV

| Step | Example 8 | | | |
|---|---|---|---|---|
| | Water-Break | Residue | Fog Spots | PAT |
| DI Rinse 1 | 1 | 3 | 3 | 1340 |
| A Clean | 3 | 3 | 3 | 1164–1168 |

The results of the foregoing examples illustrate that the cutting fluid of the present invention provides excellent water-break, low residues, and high PAT values, particularly as compared to commercially available lubricants and cutting fluids.

Example 9 and Comparative Examples 18–23

Example 9 and Comparative Examples 18–23 demonstrate the bacteria formation prevention ability of the biocide THPS as compared to UV light treatment and flushing of equipment with NaOCl (sodium hypochlorite). The cutting fluid tested in Example 9 comprised 2.0% polyethylene glycol, 0.02% triethanolamine, 3.0% polyoxyethylene glycol sorbitan monolaurate (Alkamuls PSML20), 0.02% Dow Corning 190 polysiloxane surfactant and 0.1% THPS, balance water. The cutting fluid of Comparative Examples 18–23 are identical to Example 9 except that the cutting fluids do not contain any biocide (THPS).

The test method involved lathing aluminum substrates with the cutting fluid using the designated bacteria prevention method, and inspecting the substrates for resist spots formed due to the presence of bacteria. The results in Table XV below show the yield of acceptable substrates (free of resist spots) and the overall percentage of substrates rejected due to resist spots being present. The remaining percent of rejected substrates were rejected for reasons other than resist spot formation.

Also evaluated is red spot formation in cultures of the cutting fluids. Samples of each of the cutting fluids were placed on slides and incubated for 24 hrs at 85° F. The slides are commercially available under the tradename HYCHECK. A photograph is taken of the slide, and the "red spots" (i.e., colony forming units) formed are counted. The red spots represent colonies of bacteria. An amount of red spots less than $10^5$ is on the borderline of acceptability, with less than $10^3$ being preferred since more bacteria growth than this creates the problems discussed above.

Example 9 lathes an aluminum substrate at ambient temperature. Comparative Examples 18 and 19 consist of two different lathe runs with UV light treatment at 17° C. Comparative Examples 20 and 21 involve two different lathe runs with UV light treatment at 38° C. Comparative Example 22 involves lathing with daily cleaning, i.e., removing the old cutting fluid, flushing the reservoir several times with deionized water and refilling with fresh cutting fluid. Comparative Example 24 involves lathing with weekly sterilization of the equipment with NaOCl.

TABLE XV

| Test | # of substrates | yield % | % rejected for resist spots | CFU's* |
|---|---|---|---|---|
| Ex. 9 | 1920 | 91.7 | 1.47 | $<10^3$ |
| Comp. 18 | 2160 | 92.0 | 0.77 | $10^4$–$10^5$ |
| Comp. 19 | 3360 | 91.5 | 1.53 | $10^4$–$10^5$ |
| Comp. 20 | 3600 | 67.8 | 21.8 | $10^5$ |
| Comp. 21 | 2160 | 74.0 | 10.9 | $10^5$ |
| Comp. 22 | 3600 | 85.3 | 6.18 | $>10^7$ |
| Comp. 23 | 2880 | 84.0 | 7.8 | $>10^7$ |

*CFU = colony forming unit

The above results indicate that use of a biocide such as THPS provides excellent prevention of bacteria growth with very good yield of acceptable substrates and very little resist spot rejections. Further, the use of the biocide is less expensive than processes such as UV light treatment that prevent bacteria growth at the edge of acceptability.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An aqueous-based cutting fluid comprising:

(A) about 0.01 to about 5 parts by weight of at least one antioxidant;

(B) about 0.1 to about 5 parts by weight of one or more surfactants, wherein at least one of the surfactants is a water-soluble polysiloxane surfactant in an amount of about 0.01 to about 3 parts by weight;

(C) about 1 to about 20 parts by weight of at least one lubricant; and (D) about 70 to about 98.9 parts by weight deionized water, wherein the pH of said cutting fluid is from about 7.0 to about 8.0.

2. A cutting fluid according to claim 1, wherein the cutting fluid comprises:

(A) about 0.01 to about 1 parts by weight of the at least one antioxidant;

(B) about 1 to about 4 parts by weight of the one or more surfactants, inclusive of about 0.01 to about 1 part by weight of the at least one water-soluble polysiloxane surfactant;

(C) about 1 to about 4 parts by weight of the at least one lubricant; and (D) about 90 to about 98 parts by weight of deionized water.

3. A cutting fluid according to claim 1, wherein the at least one antioxidant is selected from the group consisting of an amine and a carboxylic acid salt.

4. A cutting fluid according to claim 1, wherein the at least one antioxidant is selected from the group consisting of triethanolamine, ethylene diamine tetraacetic acid, an amine borate and an amine carboxylate.

5. A cutting fluid according to claim 1, wherein said water-soluble polysiloxane surfactant is selected from the group consisting of an ethoxylated and a propoxylated polysiloxane having a hydrophilic/lipophilic balance of 10 or more.

6. A cutting fluid according to claim 1, wherein said one or more surfactants comprise at least one additional surfactant different from said water-soluble polysiloxane surfactant, wherein the at least one additional surfactant comprises a non-ionic, non-foaming surfactant.

7. A cutting fluid according to claim 6, wherein the at least one additional surfactant comprises at least one member selected from the group consisting of octylphenoxy polyethoxy ethanol, propylene oxide/ethylene oxide copolymer, and polyoxyethylene glycol sorbitan monolaurate.

8. A cutting fluid according to claim 1, wherein the at least one lubricant comprises a polyhydric alcohol or a polymer of a polyhydric alcohol.

9. A cutting fluid according to claim 1, wherein the at least one lubricant comprises at least one member selected from the group consisting of glycerin, polyethylene glycol, pentaerythritol, sorbitan monolaurate and sorbitan trioleate.

10. A cutting fluid according to claim 1, wherein said cutting fluid additionally contains at least one biocide in an amount ranging from about 0.01 to about 1 volume percent of the cutting fluid.

11. A cutting fluid according to claim 10, wherein said biocide is a biocide that does not alter surface chemistry of a substrate which the cutting fluid contacts.

12. A cutting fluid according to claim 10, wherein said biocide is selected from the group consisting of benzalkonium chloride, tris(hydroxymethyl)nitromethane and tetrakishydroxymethylphosphonium sulphate.

13. A cutting fluid according to claim 1, wherein said cutting fluid additionally contains at least one acid selected from the group consisting of citric acid, boric acid, tartaric acid and acetic acid.

14. A cutting fluid according to claim 1, wherein the pH of the cutting fluid ranges from about 7.5 to about 8.0.

15. An aqueous based cutting fluid comprising:

(A) about 0.01 to about 0.02 parts by weight of triethanolamine;

(B) about 1 to about 5 parts by weight of a surfactant selected from the group consisting of polyethylene glycol sorbitan monolaurate and octylphenoxy polyethoxy ethanol, the total amount of surfactant inclusive of about 0.01 to about 0.1 parts by weight dimethyl, methyl(propylpolyethylene oxide polypropylene oxide acetate)siloxane;

(C) about 1 to about 4 parts by weight polyethylene glycol; and (D) about 90 to about 98 parts by weight deionized water, wherein said cutting fluid has a pH ranging from about 7.5 to about 8.0.

16. A cutting fluid according to claim 15, wherein said cutting fluid also contains at least one biocide in an amount ranging from about 0.01 to about 1 volume percent of the cutting fluid, said biocide being selected from the group consisting of benzalkonium chloride, tris(hydroxymethyl)nitromethane and tetrakishydroxymethylphosphonium sulphate.

17. An aqueous based cutting fluid comprising:

(A) about 1 to about 4 parts by weight of an antioxidant containing an amine borate, propylene glycol, amine carboxylate, a non-ionic surfactant and a non-silicone non-foaming agent;

(B) about 0.1 to about 2 parts by weight of octylphenoxy polyethoxy ethanol;

(C) about 0.01 to 1 parts by weight of a water-soluble polysiloxane surfactant;

(D) about 1 to about 4 parts by weight of polyethylene glycol; and (E) about 90 to about 98 parts by weight of deionized water, wherein said cutting fluid has a pH ranging from about 7.5 to about 8.0.

18. A cutting fluid according to claim 17, wherein said cutting fluid additionally contains at least one biocide in an amount ranging from 0.1 to about 1.0 volume percent of the cutting fluid, said biocide being selected from the group consisting of benzalkonium chloride, tris(hydroxymethyl)nitromethane and tetrakishydroxymethylphosphonium sulphate.

19. An aqueous-based cutting fluid comprising:

(A) about 0.1 to about 10 parts by weight of at least one antioxidant;

(B) about 0.1 to about 5 parts by weight of one or more surfactants, wherein at least one of the surfactants is a water-soluble polysiloxane surfactant in an amount of about 0.01 to about 3 parts by weight;

(C) about 1 to about 20 parts by weight of at least one lubricant;

(D) about 70 to about 98.9 parts by weight deionized water, and (E) a biocide consisting essentially of tetrakishydroxymethylphosphonium sulfate in an amount effective to inhibit bacteria formation in said cutting fluid, wherein said cutting fluid has a pH ranging from about 7.5 to about 8.0.

20. A cutting fluid according to claim 19, wherein said one or more surfactants comprise at least one additional surfactant different from said polysiloxane surfactant, wherein the at least one additional surfactant comprises a non-ionic, non-foaming surfactant.

21. A cutting fluid according to claim 17, wherein said water-soluble polysiloxane surfactant is selected from the group consisting of an ethoxylated and a propoxylated polysiloxane having a hydrophilic/lipophilic balance of 10 or more.

22. A cutting fluid according to claim 19, wherein said water-soluble polysiloxane surfactant is selected from the group consisting of an ethoxylated and a propoxylated polysiloxane having a hydrophilic/lipophilic balance of 10 or more.

* * * * *